US005690237A

United States Patent [19]

Marzec

[11] Patent Number: 5,690,237

[45] Date of Patent: Nov. 25, 1997

[54] INJECTION MOLDED GRAB BAR

[75] Inventor: Richard E. Marzec, Higganum, Conn.

[73] Assignee: Plumb Pak Corporation, Newington, Conn.

[21] Appl. No.: 555,576

[22] Filed: Nov. 8, 1995

[51] Int. Cl.[6] ..... A47F 7/00

[52] U.S. Cl. ..... 211/105.1; 211/123

[58] Field of Search ..... 211/105.1, 123, 211/182, 16, 105.2; 4/576.1; 248/251

[56] References Cited

U.S. PATENT DOCUMENTS

| | | | |
|---|---|---|---|
| 248,865 | 11/1881 | Leonard | 211/123 X |
| 3,156,977 | 11/1964 | Logan | 211/105.2 X |
| 4,729,482 | 3/1988 | Nicholson | 211/105.2 |
| 4,991,724 | 2/1991 | Wei | 211/105.1 X |
| 5,050,252 | 9/1991 | Cuttriss | 211/105.2 X |
| 5,269,419 | 12/1993 | Aldeguer et al. | 211/182 X |
| 5,385,248 | 1/1995 | Klein, Jr. | 211/105.1 |

*Primary Examiner*—Alvin C. Chin-Shue
*Assistant Examiner*—Sarah L. Purol
*Attorney, Agent, or Firm*—Chilton, Alix & Van Kirk

[57] ABSTRACT

An injection molded grab bar for mounting to a surface comprising (a) at least one substantially rigid elongated tube having first and second end portions and an intermediate portion therebetween, wherein the diameter of the outer surface of the intermediate portion varies along the length of the elongated tube, and the first and second end portions each elongated tube have a plurality of splines on the outer surface thereof; and (b) at least one substantially rigid, integrally formed surface connector for mounting the grab bar to the surface having, at least one substantially tubular portion, wherein inner surface of at least one substantially tubular portion has a plurality of opposite splines which engage corresponding splines on the outer surface of the first and second end portions of each elongated tube to fixedly join the elongated tube to at least one surface connector.

11 Claims, 3 Drawing Sheets

INJECTION MOLDED GRAB BAR

BACKGROUND OF THE INVENTION

1. Field of the Invention

The present invention generally relates to support rails for mounting to walls, floors and the like. More particularly, the present invention relates to injection molded bathroom safety grab bars, and especially modular grab bars which may be provided as kits comprising a plurality of injection molded components which can be assembled into a variety of different grab bar configurations, and to a method of assembling and installing safety support rails. Accordingly, the general objects of the present invention are to provide novel and improved articles and methods of such character.

2. Background of the Invention

The bathrooms of modem households have long been the locale of serious accidents. This is largely due to the fact that many common bathroom components such as showers, toilets, sinks and bathtubs are fabricated from particularly hard materials such as tile, marble, metal or porcelain which tend to become slippery when exposed to water. When a user slips while using these facilities, and is unable to regain his/her balance, there is a great danger of impact with the bathtub, water faucet, etc. with resulting serious injury. The danger of injury caused by slipping becomes particularly acute when a user is exiting a bathtub or shower since both the user and the bathtub are wet and the user is often slightly off balance when entering or exiting the bathtub. The potential for a serious bodily injury due to some or all of the dangers mentioned above increases if the user is physically or mentally disabled, elderly or a particularly young child. In fact, due to their varying degrees and types of disabilities, such users are often at risk even if the bathroom facility surfaces are not wet.

In the past, attempts to improve bathroom safety have taken many forms. For example, plastic bathtub mats, with suction cups for gripping the bathtub, and variously shaped, adhesive backed plastic stickers have long been available for use in showers and bathtubs. By providing a less slippery surface for the user to stand on while entering, using and exiting the bathtub or shower, these products have helped to reduce the danger of slipping in bathtub and showers. Additionally, shower doors having handles built into the door have also helped reduce the risk of slipping in the bathroom by providing a relatively rigid means of support. Furthermore, in recent years bathrooms have often been equipped with one or more handrails for a user to hold on to while entering, using or exiting the bathroom facilities.

The use of various types of handrails to help reduce the risk of injury in the bathroom is widespread. These handrails, variously known as handrails, grab bars, handle bars and support rails, are an effective way to minimize the risk of injury in the bathroom. Handrails are often mounted on the walls in the vicinity of toilets, showers, bathtubs and the like but they can be partially mounted to floors and/or ceilings if necessary. Existing handrails are made of various rigid materials, such as stainless steel, chrome plated steel or PVC plastic, and sometimes have textured surfaces to aid gripping by the user. Commonly, these existing handrails consist of an elongated tube which is angled by 90 degrees at each end and a pair of mounting brackets which engage the angled end portions of the tube for affixing the tube to a wall.

The prior art handrails suffer from a number of deficiencies. For example, while the handrails which are made of stainless steel are rust proof and offer excellent strength, they are also relatively expensive, cannot be easily reconfigured for a custom installation, leave unsightly screws exposed to view and need to be painted if the user desires the color of the hand rail to match the color of the room in which it is installed.

Another type of prior art hand rail consists of a number of components formed from PVC plastic which can be assembled on site. While such modular handrails overcome some of the above-mentioned disadvantages of metal bars, they are still less than ideal in that they leave unsightly screws exposed to view and require a complex, messy and lengthy installation procedure which includes the use of brushes, rags and various chemicals to clean and glue the components together, Furthermore, because these prior modular handrails have joints which are held together with glue and joining plugs, it is possible for users to unwittingly assemble the components into a handrail which is inherently weak and, therefore, susceptible to breaking when suddenly subjected to forces as will occur when gripped by an off-balance individual, Thus, such handrails are unsuitable for many applications including wall-to-floor toilet support rails and floor-to-ceiling poles.

Further, all existing handrails suffer from the problem that the they employ tubes which have a substantially constant diameter along the length of the tube. Thus, while some users may find these handrails comfortable to grasp, others (particularly users who have small or fragile hands like children and the elderly) cannot easily grasp the handrail. In the case of an emergency, such users can find these handrails of little assistance.

SUMMARY OF THE INVENTION

The present invention overcomes the above-discussed and other deficiencies and disadvantages by providing an inexpensive and attractive grab bar which can be easily installed in a variety of configurations and which offers improved safety to a wider class of users.

It is thus an object of the present invention to provide an inexpensive and attractive grab bar kit which is capable of assembly into a safety support rail that can be easily installed in a variety of configurations and which offers improved safety to a wider class of users.

It is another object of the present invention to provide an inexpensive and attractive grab bar kit which is capable of being assembled into a variety of configurations without the use of either cleaning chemicals or an adhesive.

These and other objects and advantages of the present invention are achieved by providing an injection molded grab bar assembly which employs at least one ergonomically designed elongated tube of varying diameter and at least one surface connector for mounting the grab bar to a wall, floor, ceiling or the like.

The objects and advantages of the present invention are achieved, in the preferred embodiment, by providing an injection molded grab bar assembly employing at least one elongated tube having splines on an outer surface of each end portion. These end portions cooperate with connectors which each include at least one tubular portion having splines on a surface for engaging the splines on the elongated tube whereby the elongated tube and each connector may be rigidly mechanically interconnected.

Also in accordance with the preferred embodiment, a grab bar assembly of the present invention includes at least one surface connector having a substantially planar portion, a substantially tubular portion which engages the elongated tube, and a flange cover which snugly fits over the substantially planar portion.

The present invention will typically be offered in kit form. A grab bar assembly kit in accordance with the invention will include at least one ergonomically designed elongated tube of varying diameter, at least one surface connector having a substantially planar portion and a substantially tubular portion capable of being fixedly joined with the elongated tube, and a flange cover which is capable of snugly fitting over the substantially planar portion of each surface connector.

The present invention is characterized by improved safety characteristics for a wider class of users when compared to prior art handrails. Conventional handrails have heretofore been constructed with elongated tubes having a relatively constant diameter. While use of such a constant diameter tube can provide effective assistance to users with sufficiently large and strong hands, other users are unable to properly grasp such a tube because the tube diameter is too large. Another problem incident to using a tube of a constant diameter is that, in a non-horizontal installation, the user's hand can easily slip down the length of the tube as the user pulls on the tube. In either case, conventional handrails leave users with small or fragile hands unprotected precisely when they need assistance the most. The present invention overcomes these deficiencies by providing an ergonomically designed grab bar employing an elongated tube of a varying diameter. This ergonomic design offers a larger class of users comfortable grasping portions so that young and old, weak and strong alike can take full advantage of the safety that the support rail offers. Furthermore, the periodic variation in the diameter of the elongated tube reduces the possibility that a user's hand will slip down the length of the tube.

Another significant advantage of the present invention relative to the previously available modular support rails is simplified assembly of grab bar components into custom configurations. As mentioned above, while some previous handrails were only available as fully assembled units, more recently modular handrails have been developed. These modular handrails are available as kits containing a number of individual components which the user can assemble and install. However, existing modular handrails also require that the component parts be glued together. This adhesive bonding is undesirable for at least three reasons. First, the procedure for gluing the components together is a complex and lengthy process involving a pre-cleaning step, a glue application step, and a glue drying period.

Furthermore, inadvertent misalignment of components may easily occur during gluing and can render the kit useless. Also, the gluing process requires the use of several chemicals and chemical application rags and brushes. Second, prior art modular handrails required joining plugs for joining the components together. Thus, the number of parts required to complete each hand rail is necessarily increased over handrails which do not require joining plugs, thereby increasing the complexity and cost of the handrail. Finally, because the prior handrails have joints which are held together with glue and joining plugs, it is possible for users to join two elongated tubes together without using a surface connector of any kind. Such joints are inherently weak and, therefore, susceptible to breaking when subjected to forces. By contrast, the grab bar assemblies of the present invention do not require gluing. Restated, since the end portions of the elongated bar components of the invention have positive splines on the outer surface thereof that snugly mate with negative splines on the inner surface of a cooperating connector, the elongated tubes can be fixedly joined to surface mounting components without glue. Thus, the present invention permits a grab bar to be assembled without the use of tools or chemicals.

A particular advantage of the present invention resides in the fact that the end portions of the elongated tubes are incapable of mating with one another. Accordingly, each elongated tube of the present invention must be joined with some type of surface connector. This eliminates the possibility that a user will unwittingly assemble an inherently weak grab bar, as was possible with prior art handrails.

Yet another advantage of the present invention relative to previously available handrails is improved appearance. Most prior art handrails are mounted to one or more surfaces via wall flanges which have a number of countersunk screw holes for receiving flat head screws. While this arrangement allows screw heads to remain flush with the surface of the flange, it also leaves unsightly screw heads exposed to view. In contrast, while some components of the present invention utilize a surface mounting arrangement similar to that employed with prior art handrails, the present invention offers improved appearance by providing a flexible covering flange which snugly engages each surface connector thereby covering the screwheads for a more finished appearance.

BRIEF DESCRIPTION OF THE DRAWINGS

The present invention will be described below with reference to the accompanying drawings wherein like numerals represent like structures in the several figures, and where.

DETAILED DESCRIPTION OF THE PREFERRED EMBODIMENTS

Figure 1:
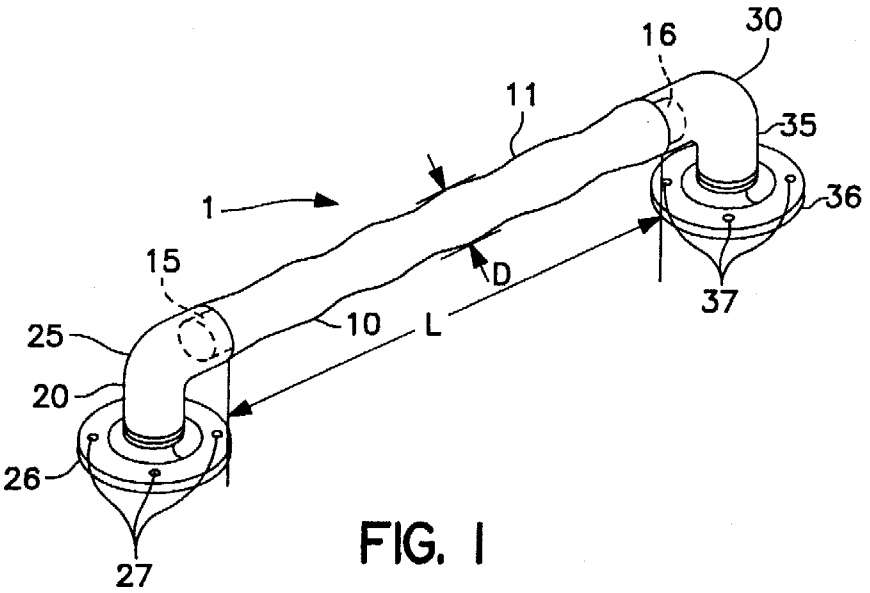
FIG. 1 is a perspective view, partly in phantom, of one embodiment of an injection molded grab bar assembly in accordance with the present invention.

A linear (i.e. single leg) injection molded grab bar assembly in accordance with the present invention is indicated generally at 1 in FIG. 1. Grab bar assembly 1 includes an elongated tube 10 having an intermediate portion 11 and first and second integral end portions 15 and 16. First end portion 15 is fixedly connected, in the manner to be described below, to a first surface connector 20 via a substantially tubular portion 25 of connector 20. Second end portion 16 is fixedly connected to another, identical surface connector 30 via a substantially tubular portion 35 of connector 30. Intermediate portion 11 of elongated tube 10 has a diameter D which periodically varies along a length L of the tube as shown. This ergonomic shape of intermediate portion 11 is contoured to comfortably allow a large class of users having a wide range of hand sizes to securely grip intermediate portion 11. Connector 20 has, in addition to substantially tubular portion 25, a substantially planar portion 26 for mounting grab bar 1 to a surface. Connector 30 also has a substantially planar portion 36 which, like substantially planar portion 26, is for mounting grab bar 1 to a surface. Optionally, substantially planar portions 26 and 36 of surface connectors 20 and 30, respectively, can be affixed to a surface by any known means such as a suitable waterproof adhesive or they can have plural and through holes 27 and 37, respectively, for receiving surface mounting screws.

The preferred material for grab bar 1 is a plastic polymer. With the preferred material, the component parts of grab bar 1 (i.e. elongated tube 10, and the connectors 20 and 30) can be individually injection molded and then assembled, without using an adhesive, into grab bar 1 as shown in FIG. 1. Injection molding allows the several portions of each grab bar component to be integrally formed thereby improving strength, lowering the number of parts and reducing costs.

Figure 2:
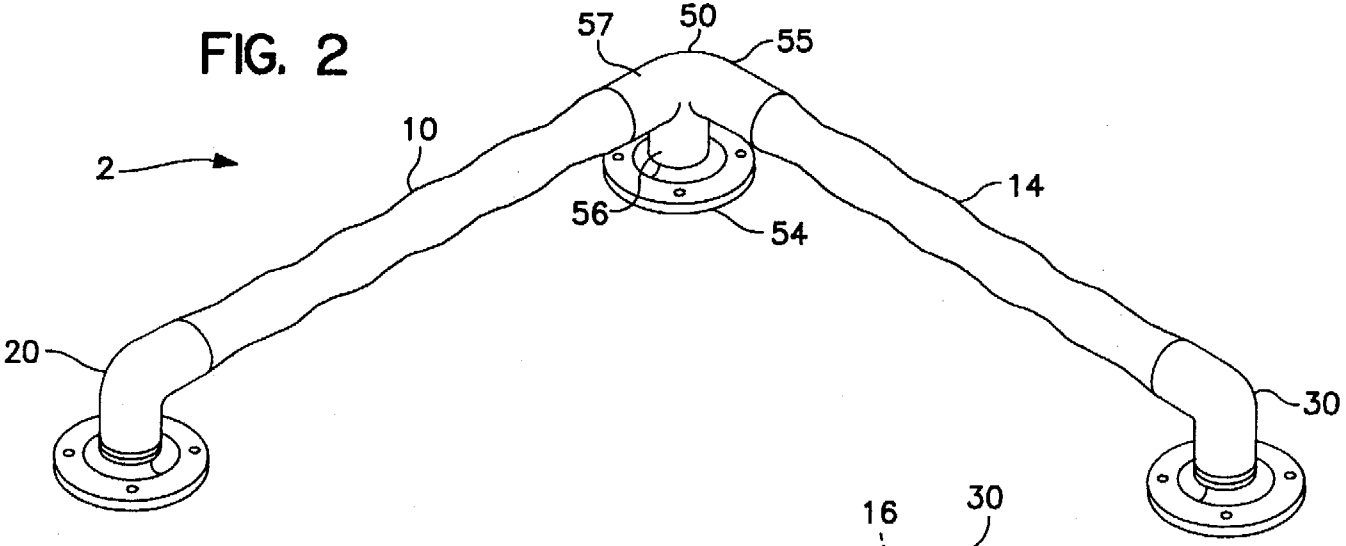
FIG.2 is a perspective view of another embodiment of an injection molded grab bar, assembly in accordance with the present invention.
Figure 3:
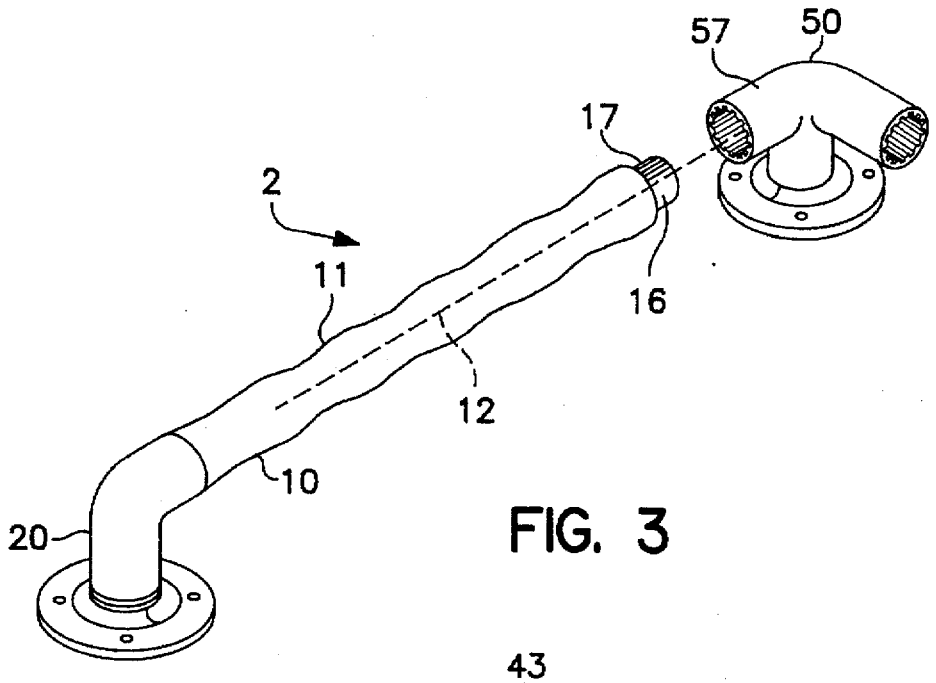
FIG. 3 is a partial, exploded perspective view of the FIG. 2 embodiment of an injection molded grab bar assembly in accordance with the present invention.

FIG. 2 generally shows a two leg grab bar 2 in accordance with another embodiment of the present invention. Grab bar 2 has substantially the same attributes as those of grab bar 1 discussed above, but employs additional components. Specifically, grab bar 2 has a surface connector 50 which engages tube 10, and a second elongated tube 14. Tube 14 is fixedly joined at its opposite ends respectively to connector 30 and connector 50. As shown in FIG. 2, first and second substantially tubular portions 57 and 55 of surface connector 50 are substantially perpendicular to each other and to a third substantially tubular portion 56. Surface connector 50 also has a substantially planar foot portion 54 for mounting grab bar 2 to a surface, With reference to FIG. 3, the manner in which the components of a grab bar assembly in accordance with the invention are fixedly joined will now be explained. The outer surface of end portion 16 of elongated tube 10 is provided with a plurality of positive splines 17 which extend substantially parallel to axis 12 of tube 10. The inner surface of tubular portion 57 of surface connector 50 has a plurality of corresponding negative splines which mate with positive splines 17 to fixedly join elongated tube 10 to surface connector 50 when grab bar 2 is assembled. Alternatively, the inner surface of substantially tubular portion 57 of surface connector 50 can have a plurality of positive splines and the outer surface of end portion 16 can have a plurality of corresponding negative splines. Further, it should be appreciated that the terms positive and negative splines are intended to refer to any structure known in the art (such as detents and dimples) that can be employed to fixedly join elongated tube 10 to surface connector 50 as long as the structure minimizes rotation between the two components.

With reference to FIGS. 4*a*–4*d*, several of the many possible surface connectors in accordance with the present invention will now be described.

Figure 4A:
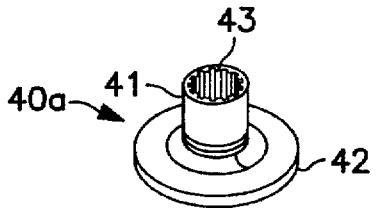
FIG. 4*a* is a perspective view of a first surface connector in accordance with the present invention.

FIG. 4*a* shows one surface connector 40*a* having a first substantially tubular portion 41 wherein an inner surface of tubular portion 41 has a plurality of splines 43 capable of engagement with corresponding opposite splines on the outer surface of an end portion of an elongated tube such as elongated tube 10 of FIG. 1. As shown, first tubular portion 41 is substantially perpendicular to a substantially planar portion 42. However, it should be appreciated that tubular portion 41 can be angled relative to substantially planar portion 42.

Figure 4B:
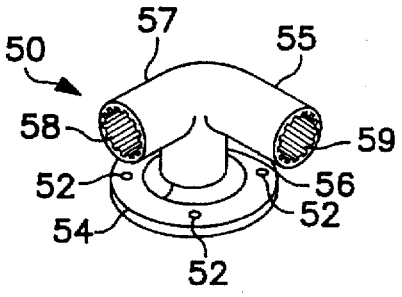
FIG. 4*b* is a perspective view of a second surface connector in accordance with the present invention.

FIG. 4*b* is a perspective view of a second surface connector 50 in accordance with the present invention which has a first substantially tubular portion 56, a second substantially tubular portion 57 and a third substantially tubular portion 55, wherein first and second tubular portions 56, 59 are substantially perpendicular to each other and to third tubular portion 55. However, first, second and third tubular portions can be angled in any desired direction relative to each other. As shown, an inner surface of second tubular portion 57 and an inner surface of third tubular portion 55 each have a plurality of splines, 58 and 59, respectively, capable of engagement with corresponding opposite splines on the outer surface of an end portion of an elongated tube such as elongated tube 10 of FIG. 1. Additionally, surface connector 50 has a substantially planar portion 54 which defines a plurality of through holes 52 for receiving surface mounting screws.

Figure 4C:
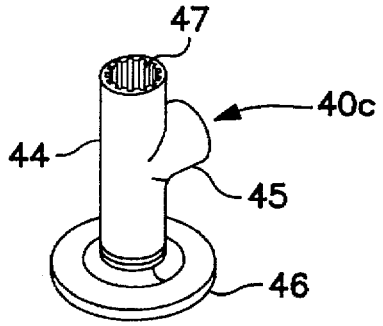
FIG. 4*c* is a perspective view of a third surface connector in accordance with the present invention.

FIG. 4*c* shows a third surface connector 40*c* in accordance with the present invention which is similar to the surface connectors described above. Surface connector 40*c* has a first substantially tubular portion 44 and a second substantially tubular portion 45, which is substantially perpendicular to first substantially tubular portion 44. However, any appropriate angular orientation between tubular portions 44 and 45 is also within the scope of the invention. As shown in FIG. 4*c*, second substantially tubular portion 45 extends from first substantially tubular portion 44 in a region between a substantially planar portion 44 and an end 47 of first substantially tubular portion 44.

Figure 4D:
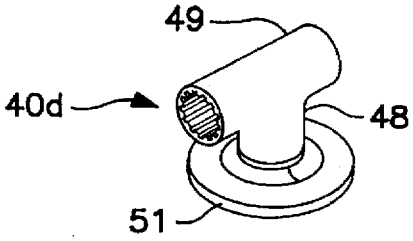
FIG. 4*d* is a perspective view of a fourth surface connector in accordance with the present invention.

FIG. 4*d* shows a fourth surface connector 40*d* in accordance with the present invention which is similar to the surface connectors described above. As shown, surface connector 40*d* has a first substantially tubular portion 48 and a second substantially tubular portion 49 extending substantially perpendicularly relative to the end of first substantially tubular portion 48 which is opposite a substantially planar portion 51.

Figure 5:
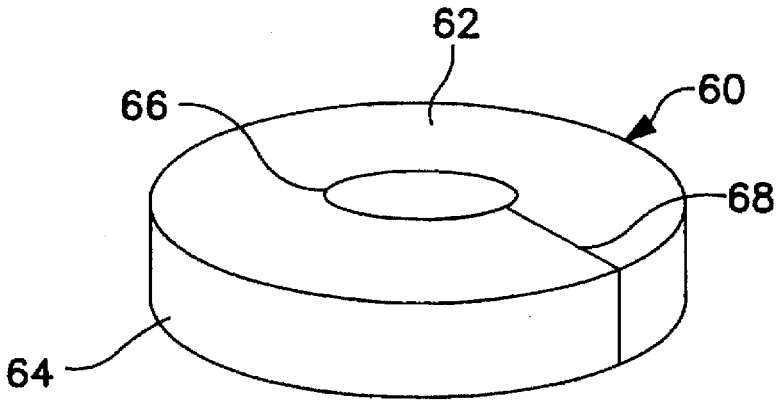
FIG. 5 is a perspective view of a covering flange in accordance with the present invention.

FIG. 5 shows a covering flange 50 in accordance with the present invention. As shown, covering flange 50 has a top portion 62 and a side portion 64 extending from top portion 62 at some angle. In this embodiment, top portion 52 and side portion 64 cooperte to form continuous aperature 56 and slit 58. Preferably, covering flange 50 is made of a flexible and resilient material so that covering flange 50 can be twisted, thereby enlarging slit 68 sufficiently wide to slide over the substantially tubular portion of a surface connector, and mounted to that surface connector.

Figure 6:
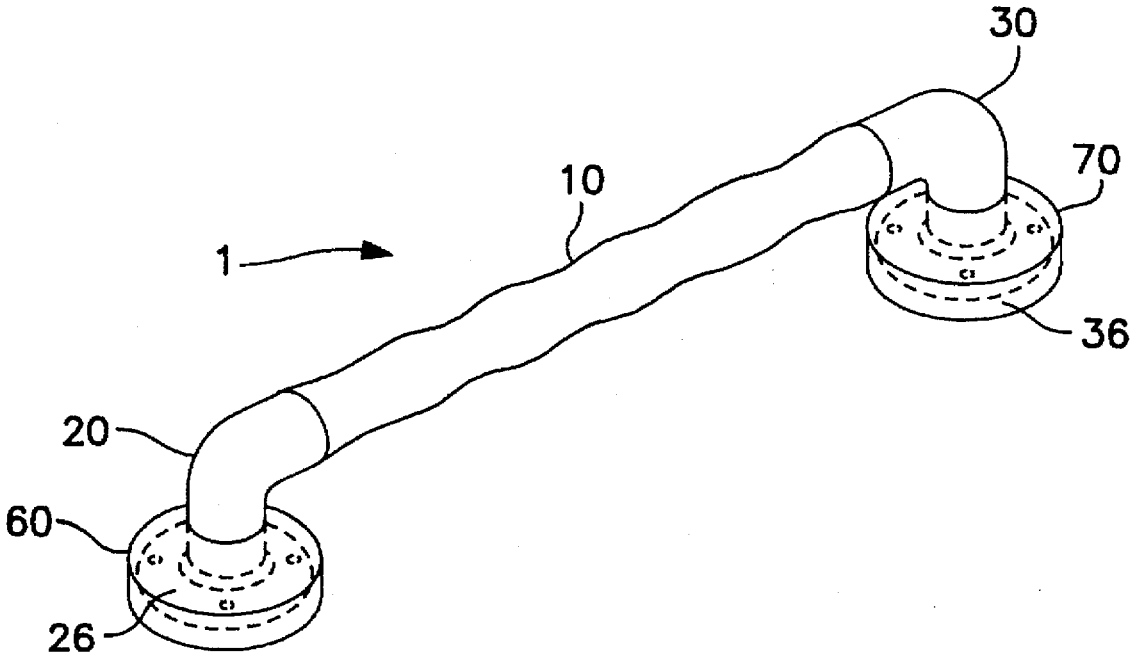
FIG. 6 is a perspective view, partly in phantom, of another injection molded grab bar assembly in accordance with the present invention.

FIG. 6 generally shows grab bar 1 of FIG. 1 having first and second surface connectors 20 and 30 and elongated tube 10 fixedly joined, therebetween. In this embodiment, grab bar 1 also has a first covering flange 60 snugly engaging surface connector 20 such that substantially planar portion 26 is completely covered. Further, grab bar 1 also has a second covering flange 70 snugly engaging surface connector 30 such that substantially planar portion 36 is completely covered. Preferably, first and second covering flanges 60 and 70 are formed by injection molding a plastic polymer to a shape, color and texture consistent with the rest of grab bar 1.

While a number of embodiments of the invention have been illustrated and described in detail, it should be readily appreciated that many modifications and changes are within the skill of those of ordinary skill in the art. Therefore, the appended claims are intended to cover any and all of such modifications which fall within the spirit and scope of the invention and not limited to the embodiments expressly described above.

I claim:

1. An injection molded grab bar for mounting to a surface comprising:

(a) at least one substantially rigid elongated tube, said tube having an axis and first and second end portions, said tube further having a unitary intermediate portion extending between and integral with said end portions, the outer diameter of said intermediate portion varying continuously and smoothly along its length between maximum and minimum diameters whereby said tube intermediate portion has an undulating profile; and (b) at least one substantially rigid, integrally formed surface connector for supporting said tube in spaced relation to a substantially planar surface with the axis of said tube being substantially parallel to the surface, said surface connector having, 1. a substantially planar portion for attachment to the surface, and 2. a tubular portion integral with and extending from said planar portion, said tubular portion of said connector defining at least a first socket said first socket having an axis and an internal cross-sectional size and shape which is complementary to the external cross-sectional size and shape of said end portions of said elongated tube whereby an end portion of said tube may be coaxially engaged in said first socket and said tube will in part be rigidly supported relative to the surface by said connector.

2. An injected molded grab bar as recited in claim 1, wherein said connector tubular portion further defines a support leg having an axis which is substantially perpendicular to the axis of said first socket.

3. An injection molded grab bar as recited in claim 2, wherein the outer diameter of the intermediate portion of said elongated tube periodically varies along the length of the tube within the range of about 1 to 2 inches.

4. An injection molded grab bar as recited in claim 3, further comprising at least one removable cover for covering said substantially planar portion of said surface connector.

5. An injected molded grab bar as recited in claim 3, wherein the first and second end portions of said elongated tube have at least one spline on the outer surface thereof which is substantially parallel to the axis of said elongated tube, and wherein said first socket of said connector has at least one corresponding opposite spline which cooperates with a said spline on a said end portion of said tube.

6. An injection molded grab bar as recited in claim 5, wherein said first and second end portions of said tube are provided with a plurality of integrally formed splines.

7. An injection molded grab bar as recited in claim 6, wherein said connector further defines a second socket having an axis, and wherein the axes of said support leg and having an axis first socket are substantially perpendicular to the axis of said second socket.

8. An injection molded grab bar kit having component parts capable of being assembled into a grab bar for mounting to a planar support surface, said kit comprising:

(a) at least one substantially rigid, integrally formed, elongated tube having first and second end portions and an intermediate portion therebetween, the outer diameter of said intermediate portion varying continuously and smoothly along its length between said end portions; and (b) at least a pair of substantially rigid, integrally formed surface connectors capable of supporting said tube in spaced relation to a support surface, said surface connectors each having, 1. a mounting portion, said mounting portion having a substantially planar mounting flange, said flange being provided with apertures having axes which are oriented substantially perpendicular to the support surface when said connector is in use, said apertures being sized and shaped to receive mechanical fasteners, 2. a first tubular portion, said first tubular portion having an axis which is oriented substantially parallel to the axes of said apertures in said mounting flange, said first tubular portion defining a leg which extends outwardly from said mounting flange; and 3. at least a second tubular portion extending from said first tubular portion, said second tubular portion having an axis which is substantially perpendicular to said axis of said first tubular portion, said second tubular portion defining a first socket having an internal cross-sectional size and shape which is complementary to the external cross-sectional size and shape of said tube end portions whereby an end portion of said tube may be coaxially engaged in said first socket and said tube will in part be rigidly supported relative to the surface by said connector.

9. A kit as recited in claim 8 further comprising a removable snap-on cover for the mounting flange of each of said surface connectors.

10. A kit as recited in claim 8, wherein said first and second end portions of said elongated tube have at least one spline on the outer surface thereof which is substantially parallel to the axis of said elongated tube, and wherein each of said surface connector defined sockets has at least one corresponding opposite spline on an interior surface thereof capable of cooperation with a said spline on an end portion of said elongated tube.

11. A kit as recited in claim 10, wherein at least one of said surface connectors further comprises a third tubular portion having an axis, said third tubular portion defining a second socket for receiving an end portion of said tube, and wherein the axis of said third tubular portion is substantially perpendicular to the axes of said first and second tubular portions.

* * * * *